United States Patent [19]

Tokita et al.

[11] Patent Number: 5,001,008

[45] Date of Patent: Mar. 19, 1991

[54] REINFORCING FIBROUS MATERIAL

[75] Inventors: Suguru Tokita, Waki; Hajime Inagaki, Iwakuni, both of Japan

[73] Assignee: Mitsui Petrochemical Industries, Ltd., Tokyo, Japan

[21] Appl. No.: 222,578

[22] Filed: Jul. 21, 1988

[30] Foreign Application Priority Data

Jul. 21, 1987 [JP] Japan ..... 62-179967

[51] Int. Cl.[5] ..... B32B 9/04; D02G 3/00

[52] U.S. Cl. ..... 428/400; 428/364; 428/447; 428/401

[58] Field of Search ..... 428/364, 394, 391, 447, 428/400, 397, 401; 525/288

[56] References Cited

U.S. PATENT DOCUMENTS

| | | | |
|---|---|---|---|
| 3,646,155 | 2/1972 | Scott | 525/288 |
| 4,048,129 | 9/1977 | Voigt | 525/262 |
| 4,182,398 | 1/1980 | Salyer et al. | 252/70 X |
| 4,410,586 | 10/1983 | Ladizesky et al. | 428/245 |
| 4,413,110 | 11/1983 | Kavesch et al. | 428/902 X |
| 4,870,136 | 9/1989 | Yagi et al. | 525/288 |

*Primary Examiner*—Lorraine T. Kendell

*Attorney, Agent, or Firm*—Sherman & Shalloway

[57] ABSTRACT

Disclosed is a reinforcing fibrous material having an improved adhesion, which consists essentially of a surface-treated, molecularly oriented, silane-crosslinked ultra-high-molecular-weight polyethylene fiber, wherein when the measurement is conducted under restraint conditions by using a differential scanning calorimeter, the crosslinked polyethylene fiber has at least two crystal melting peaks (Tp) at temperatures higher by at least 10° C. than the inherent crystal melting temperature (Tm) of the ultra-high-molecular-weight polyethylene determined as the main peak at the time of the second temperature elevation, the heat of fusion based on these crystal melting peaks (Tp) is at least 50% of the whole heat of fusion, and the sum of heat of fusion of high-temperature side peaks (Tp1) at temperatures in the range of from (TM+35)° C. to (Tm+120)° C. is at least 5% of the whole heat of fusion, and wherein the crosslinked polyethylene fiber has a surface containing at least 8 carbon atoms, especially at least oxygen atoms, per 100 oxygen atoms, as determined by the electron spectroscopy for chemical analysis.

15 Claims, 3 Drawing Sheets

X 1000

AFTER TREATMENT

X 1000

AFTER TREATMENT

X 1000

BEFORE TREATMENT

REINFORCING FIBROUS MATERIAL

BACKGROUND OF THE INVENTION (1) Field of the Invention

The present invention relates to a reinforcing fiber. More particularly, the present invention relates to a reinforcing fibrous material comprising a surface-treated, molecularly oriented, silane-crosslinked ultra-high-molecular-weight polyethylene fiber, which is excellent in the combination of the adhesion to a matrix and the creep resistance and is capable of prominently improving the strength of a composite material (2) Description of the Related Art Fiber-reinforced plastics are excellent in strength and rigidity, and therefore, they are widely used as automobile parts, electric appliance parts, housing materials, industrial materials, small ships, sporting goods, medical materials, civil engineering materials, construction materials and the like. However, since almost all of fibrous reinforcers of these fiber-reinforced plastics are composed of glass fibers, the obtained composite materials are defective in that their weights are much heavier than those of unreinforced plastics. Accordingly, development of a composite material having a light weight and a good mechanical strength is desired.

A filament of a polyolefin such as high-density polyethylene, especially ultra-high-molecular-weight polyethylene, which has been drawn at a very high draw ratio, has a high modulus, a high strength and a light weight, and therefore, this filament is expected as a fibrous reinforcer suitable for reducing the weight of a composite material.

However, the polyolefin is poor in the adhesion to a matrix, that is, a resin or rubber, and the polyolefin, especially polyethylene, is still insufficient in the heat resisting and the creep is easily caused even at a relatively low temperature.

As the means for improving the adhesion, there have been proposed a method in which a polyolefin molded article is subjected to a plasma discharge treatment to improve the adhesion to a matrix (see Japanese Patent Publication No. 794/78 and Japanese Patent Application Laid-Open Specification No. 177032/82) and a method in which a polyolefin molded article is subjected to a corona discharge treatment to improve the adhesion to a matrix (see Japanese Patent Publication No. 5314/83 and Japanese Patent Application Laid-Open Specification No. 146078/85). The reason of the improvement of the adhesion according to these methods is that, as described in Japanese Patent Application Laid-Open Specification No. 177032/82 and Japanese Patent Publication No. 5314/83, many fine convexities and concavities having a size of 0.1 to 4$\mu$ are formed on the surface of the polyolefin molded article and the adhesiveness of the surface of the molded article is improved by the presence of these fine convexities and concavities. In Japanese Patent Application Laid-Open Specification No. 146078/85, it is taught that even if the corona discharge treatment is carried out so weakly that the total irradiation quantity is 0.05 to 3.0 Watt·min/m$^2$, a very fine haze should be formed on the filament by the discharge, and in Table 1 on page 3 of this specification, it is shown that if the corona discharge treatment is conducted once at such a small irradiation quantity as 0.2 Watt·min/m$^2$, the tensile strength is reduced to 60 to 70% of the strength of the untreated filament. It is construed that this reduction of the strength is probably due to the fine convexities and concavities formed on the entire surface.

The improvement of the adhesiveness of the polyolefin fiber as attained in the prior art is due to the increase of the bonding specific surface area or the production of the anchoring effect by formation of fine convexities and concavities on the fiber surface, but reduction of the mechanical strength of the fiber per se by this treatment cannot be avoided. Therefore, the composite material comprising this fiber as the reinforcer is still insufficient in mechanical properties such as the flexural strength.

SUMMARY OF THE INVENTION

We previously found that if a silane compound is grafted to ultra-high-molecular-weight polyethylene having an intrinsic viscosity ($\eta$) of at least 5 dl/g in the presence of a radical initiator, the grafted polyethylene is extrusion-molded, the extrudate is impregnated with a silanol condensation catalyst during or after drawing and the extrudate is exposed to water to effect crosslinking, a novel molecularly oriented molded body in which an improvement of the melting temperature, not observed in the conventional drawn or crosslinked molded body of polyethylene, is attained is obtained, and that even if this molecularly oriented molded body is exposed to a temperature of 180° C. for 10 minutes, the molded body is not molten but the original shape is retained and a high strength retention ratio can be maintained even after this heat history. It also was found that in this drawn molded body, the high modulus and high strength inherent to the drawn molded body of ultra-high-molecular-weight polyethylene can be maintained and the creep resistance is prominently improved.

We have now found that if this molecularly oriented, silane-crosslinked ultra-high-molecular-weight polyethylene fiber is subjected to a surface treatment such as a plasma treatment or a corona treatment, the adhesiveness to a matrix such as a resin, a rubber or a cement can be prominently improved without impairing the mechanical properties and creep resistance inherently possessed by the ultra-high-molecular-weight polyethylene fiber and the strength of a composite material can be highly improved We have now completed the present invention based on this finding.

More specifically, in accordance with the present invention, there is provided a reinforcing fibrous material having an improved adhesion, which consists essentially of a surface-treated, molecularly oriented, silane-crosslinked ultra-high-molecular-weight polyethylene fiber, wherein when the measurement is conducted under restraint conditions by using a differential scanning calorimeter, the crosslinked polyethylene fiber has at least two crystal melting peaks (Tp) at temperatures higher by at least 10° C. than the inherent crystal melting temperature (Tm) of the ultra-high-molecular-weight polyethylene determined as the main peak at the time of the second temperature elevation, the heat of fusion based on these crystal melting peaks (Tp) is at least 50% of the whole heat of fusion, and the sum of heat of fusion of high-temperature side peaks (Tp1) at temperatures in the range of from (Tm+35)°C. to (Tm+120)°C. is at least 5% of the whole heat of fusion, and wherein the crosslinked polyethylene fiber has a surface containing at least 8 oxygen atoms, especially at least 10 oxygen atoms, per 100 carbon atoms, as determined by the electron spectroscopy for chemical analysis (ESCA).

DETAILED DESCRIPTION OF THE PREFERRED EMBODIMENTS

The present invention is based on the finding that if a molecularly oriented and silane-crosslinked ultra-high-molecular-weight polyethylene fiber is selected as the fibrous substrate to be treated and this fiber is subjected to a surface treatment such as a plasma treatment or a corona discharge treatment, the adhesion to a matrix such as a resin can be prominently improved without reduction of the mechanical strength and other properties of the fiber.

The prior art teaches that if a polyethylene fiber is subjected to a plasma treatment or a corona discharge treatment, fine convexities and concavities (pittings) are formed on the entire surface of the fiber and the adhesion to a matrix is improved by the presence of these fine convexities and concavities. According to the present invention, however, by using a molecularly oriented and silane-crosslinked ultra-high-molecular-weight polyethylene fiber as the substrate, pittings are not formed but the surface of the fiber is kept smooth, and oxygen is bonded to the surface, whereby the adhesion is improved. Since the surface of the fiber of the present invention is as smooth as the surface of the starting fiber, the strength or modulus is not substantially reduced, and since the fiber is excellent in heat resistance and creep resisting, these excellent characteristics can be imparted to a fiber-reinforced composite body.

The molecularly oriented and silane-crosslinked ultra-high-molecular-weight polyethylene fiber used as the starting fiber is defined as a fiber formed by molecularly orienting a silane-grafted ultra-high-molecular-weight polyethylene fiber by drawing and silane-crosslinking the molecularly oriented fiber. More specifically, if silane-grafted ultra-high-molecular-weight polyethylene is subjected to a drawing operation, the silane-grafted portion is selectively rendered amorphous and an oriented crystalline portion is formed through the silane-grafted portion. If this drawn formed body is crosslinked with a silanol condensation catalyst, a crosslinked structure is selectively formed in the amorphous portion, and both the ends of the oriented crystalline portion are fixed by silane crosslinking. This molecularly oriented and silane-crosslinked structure is very advantageous for improvement of heat resisting and creep resistance of the fiber reinforcer and also prevention of formation of pittings at the surface treatment.

Figure 1:
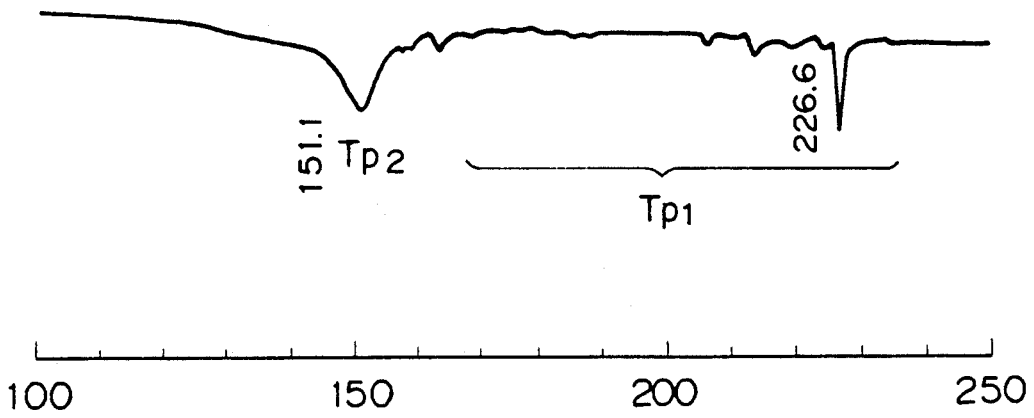
FIG. 1 is a graph illustrating melting characteristics of a filament of ultra-high-molecular-weight polyethylene crosslinked after silane-grafting and drawing.
Figure 2:
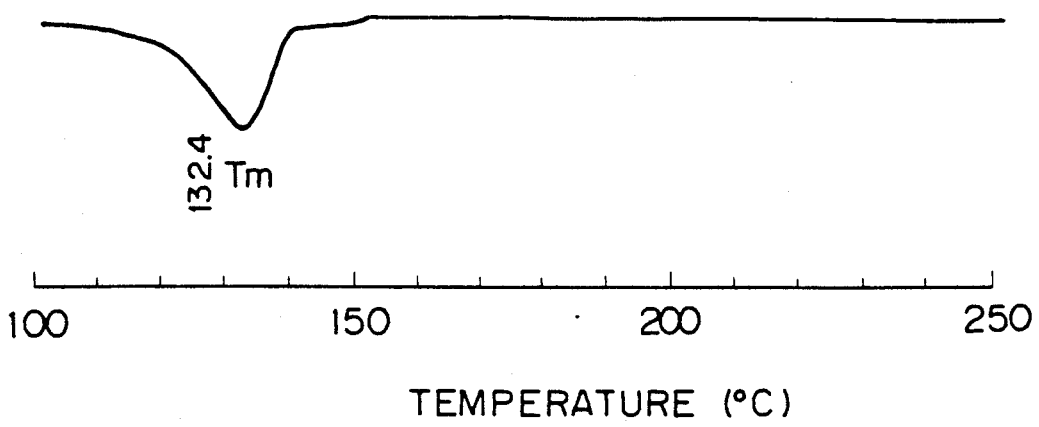
FIG. 2 is a graph illustrating melting characteristics of the sample in FIG. 1 at the time of the second temperature.

FIG. 1 of the accompanying drawings is an endothermic curve of a molecularly oriented and silane-crosslinked fiber of ultra-high-molecular-weight polyethylene used in the present invention, as determined under restraint conditions by a differential scanning calorimeter, and FIG. 2 is an endothermic curve of the starting ultra-high-molecular-weight polyethylene obtained by subjecting the sample of FIG. 1 to the second run (the second temperature elevation after the measurement conducted for obtaining the curve of FIG. 1).

The restraint conditions referred to in the instant specification mean conditions where no positive tension is given to the fiber but both the ends are secured so that free deformation is inhibited.

As shown in FIGS. 1 and 2, the molecularly oriented and silane-crosslinked fiber of ultra-high-molecular-weight polyethylene used in the present invention has such characteristics that when the measurement is conducted under restraint conditions by using a differential scanning calorimeter, the crosslinked fiber has at least two crystal melting peaks (Tp) at temperatures higher by at least 10° C. than the inherent crystal melting temperature (Tm) of the ultra-high-molecular-weight polyethylene determined as the main peak at the time of the second temperature elevation, and the heat of fusion based on these crystal melting peaks (Tp) is at least 50%, especially at least 60% of the whole heat of fusion. The crystal melting peaks (Tp) often appear as a high-temperature side melting peak (Tp1) in the range of from (Tm+35)°C. to (Tm+120)°C. and the low-temperature side peak (Tp2) in the temperature range of from (Tm+10)°C. to (Tm+35)°C. The fiber of the present invention is further characterized in that the sum of heat of fusion of the peak Tp1 is at least 5%, especially at least 10%, of the whole heat of fusion.

These high crystal melting peaks (Tp1 and Tp2) exert a function of highly improving the heat resisting of the ultra-high-molecular-weight polyethylene filament, but it is construed that it is the high-temperature side melting peak (Tp1) that makes a contribution to the improvement of the strength retention ratio after the heat history at a high temperature.

In the molecular oriented and silane-crosslinked fiber used in the present invention, the crystal melting temperature of at least a part of the polymer chain constituting the fiber is greatly shifted to the high-temperature side as stated hereinbefore, and therefore, the heat resistance is highly improved. Namely, the fiber used in the present invention has such a surprising heat resistance, not expected from conventional ultra-high-molecular-weight polyethylene, that the strength retention ratio after 10 minutes' heat history at 160° C. is at least 80%, preferably after 10 minutes' heat history at 180° C. the heat retention ratio is at least 60%, especially at least 80% and the strength retention ratio after 5 minutes' heat history at 200° C. is at least 80%.

The fiber of the present invention is excellent in the heat creep resistance. For example, under conditions of a load corresponding to 30% of the breaking load and a temperature of 70° C., the fiber of the present invention has an elongation lower than 30%, especially lower than 20%, after 1 minute's standing, while the uncrosslinked fiber shows an elongation more than 50% after 1 minute's standing under the same conditions.

Furthermore, the fiber of the present invention shows an elongation lower than 20% after 1 minute's standing under conditions of a load corresponding to 50% of the breaking load and a temperature of 70° C., while the uncrosslinked fiber is elongated and broken within 1 minute under the same conditions.

Figure 3:
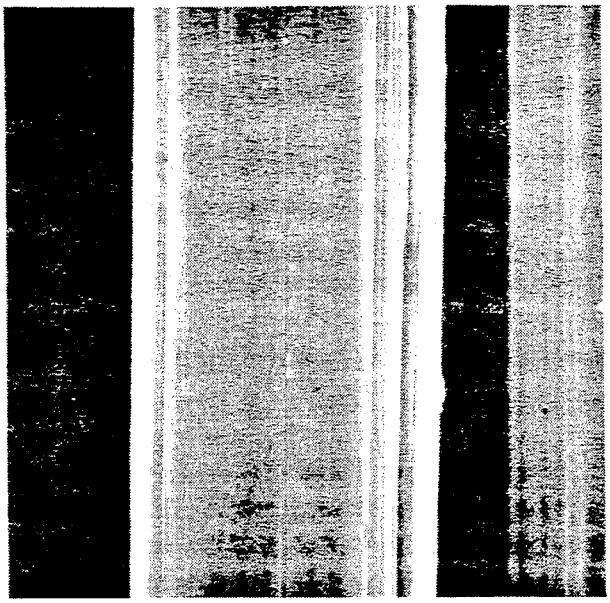
FIG. 3 is an electron microscope photograph (1000 magnifications) of the surface of a surface-treated, molecularly oriented, silane-crosslinked ultra-high-molecular-weight polyethylene fiber.
Figure 4:
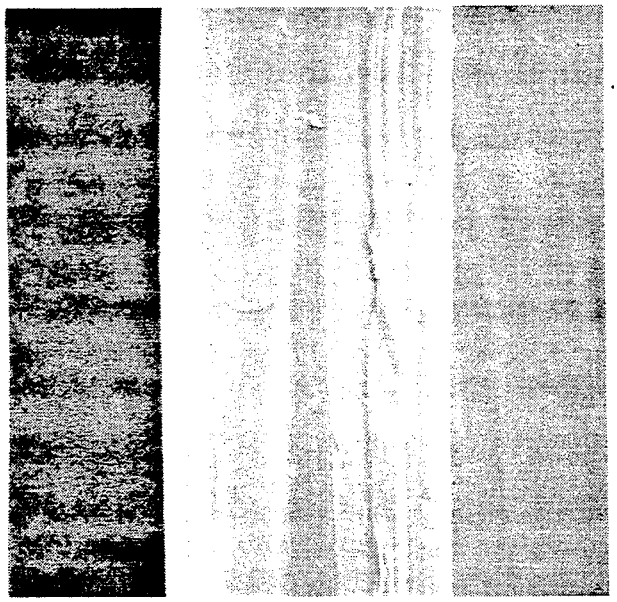
FIG. 4 is an electron microscope photograph (1000 magnifications) of the surface of an untreated, molecularly oriented, silane-crosslinked ultra-high-molecular-weight polyethylene fiber.

FIG. 3 is an electron microscope photograph (1000 magnifications) of the surface of the molecularly oriented and silane-crosslinked ultra-high-molecular-weight polyethylene fiber surface-treated according to the present invention, and FIG. 4 is an electron microscope photograph of the surface of the molecularly oriented and silane-crosslinked ultra-high-molecular-weight polyethylene fiber not surface-treated. Photographing of the surface is carried out under the following conditions after the following preliminary treatment.

Namely, the preliminary treatment is conducted according to the following procedures.

(1) A cover glass fixed to a sample stand by a double-coated tape, and a sample is fixed onto the cover glass by a double-coated tape.

(2) An electroconductive paint (silver paste supplied under the tradename of "Silvest P-225") is applied between the sample stand and the sample and between the cover glass and the sample stand.

(3) Gold is vacuum-deposited on the sample surface by a vacuum deposition apparatus (JEE 4B supplied by Nippon Denshi).

Photographing is carried out at 1000 magnifications by an electron microscope photographing apparatus (JSM 25 SIII supplied by Nippon Denshi). The acceleration voltage is 12.5 kV.

From the results shown in FIGS. 3 and 4, it is seen that the surface-treated fiber of the present invention retains a smooth surface and it is obvious that cracks having a width larger than 0.1 μm, especially larger than 0.08 μm, are not formed in the orientation direction on the surface. The conventional polyethylene fiber having convexities and concavities having a width larger than 0.1 μm on the surface has a considerably reduced mechanical strength. In contrast, in the fiber of the present invention, since the crack width is controlled below 0.1 μm, the mechanical strength is maintained at substantially the same level as before the treatment.

The surface-treated fiber of the present invention is further characterized in that the number of added oxygen atoms is at least 8, preferably at least 10, per 100 carbon atoms as determined by ESCA. The number of added oxygen atoms in the untreated, molecularly oriented and silane-crosslinked ultra-high-molecular-weight polyethylene fiber is smaller than 7 per 100 carbon atoms. In the fiber of the present invention, since the number of added oxygen atoms is increased as pointed out above, the adhesion to a matrix is prominently improved. Incidentally, the number of added oxygen atoms is determined by an X-ray photoelectronic spectrometer (ESCA Model 750 supplied by Shimazu Seisakusho) by introducing a sample stand having a sample fixed thereto by a double-coated tape into the spectrometer, reducing the pressure to $10^{-8}$ Torr and measuring $C^{1S}$ and $0^{1S}$ by using A1Kα (1486.6 eV) as the light source. After the measurement, the waveform processing is performed, peak areas of carbon and oxygen are calculated, and the relative amount of oxygen to carbon is determined.

As is apparent from the foregoing description, the improvement of the adhesion in the surface-treated, molecularly oriented and silane-crosslinked ultra-high-molecular-weight polyethylene fiber of the present invention is not due to formation of pittings on the surface of the fiber but due to addition of oxygen atoms to the surface. The reason is considered to be that the molecularly oriented and silane-crosslinked structure in the starting fiber inhibits formation of pittings but allows oxidation of the surface at the plasma treatment or corona discharge treatment.

The reinforcing fibrous material of the present invention can be obtained by shaping silane-grafted ultra-high-molecular-weight polyethylene into a fiber, drawing the fiber to form a molecularly oriented fiber, silane-crosslinking the molecularly oriented fiber in the presence of a silanol condensation catalyst, and subjecting the obtained molecularly oriented and silane-crosslinked fiber to a plasma treatment or a corona discharge treatment.

STARTING MATERIAL

The ultra-high-molecular-weight polyethylene means an ethylene polymer having an intrinsic viscosity (η) of at least 5 dl/g, preferably 7 to 30 dl/g, as measured at 135° C. in decalin as the solvent.

If the intrinsic viscosity (η) is lower than 5 dl/g, a drawn fiber having a high strength cannot be obtained even at a high draw ratio. The upper limit of the intrinsic viscosity (η) is not critical, but if the intrinsic viscosity (η) exceeds 30 dl/g, the melt viscosity at a high temperature is very high, and melt fracture is often caused and the melt spinnability is poor.

Namely, of ethylene polymers obtained by so-called Zegler polymerization of ethylene or ethylene and a small amount of other α-olefin such as propylene 1-butene, 4-methyl-1-pentene or 1-hexene, a polymer having a much higher molecular weight is meant by the ultra-high-molecular-weight polyethylene.

Any of silane compounds capable of grafting and cross-linking can be used as the silane compound for the grafting treatment. Such silane compounds have a radical-polymerizable organic group and a hydrolyzable organic group and are represented by the following general formula, $$R_nSiY_{4-n} \quad (1)$$

wherein R stands for a radical-polymerizable organic group containing an ethylenic unsaturation, Y stands for a hydrolyzable organic group, and n is a number of 1 or 2.

As the radical-polymerizable organic group, there can be mentioned ethylenically unsaturated hydrocarbon groups such as a vinyl group, an allyl group, a butenyl group and a cyclohexenyl group, and alkyl groups having an ethylenically unsaturated carboxylic acid ester unit, such as an acryloxyalkyl group and a methacryloxyalkyl group, and a vinyl group is preferred. An alkoxy group and an acyloxy group can be mentioned as the hydrolyzable organic group.

As preferred examples of the silane compound, there can be mentioned vinyltriethoxysilane, vinyltrimethoxysilane and vinyltris(methoxyethoxy)silane, though silane compounds that can be used are not limited to those exemplified above.

GRAFTING AND SHAPING

At first, a composition comprising the above-mentioned ultra-high-molecular-weight polyethylene, the above-mentioned silane compound, a radical initiator and a diluent is heat-molded by melt extrusion or the like to effect silane grafting and molding. Namely, grafting of the silane compound to the ultra-high-molecular-weight polyethylene by radicals is caused.

All of radical initiators customarily used for the grafting treatment of this type can be used as the radical initiator. For example, there can be mentioned organic peroxides, organic peresters, azobisisobutyronitrile and dimethyl azoisobutylate. In order to effect grafting under melt-kneading conditions of ultra-high-molecular-weight polyethylene, it is preferred that the half-life period temperature of the radical initiator be in the range of from 100° to 200° C.

In order to make melt-molding of the silane-grafting ultra-high-molecular-weight polyethylene possible, a diluent is incorporated together with the above mentioned components. A solvent for the ultra-high-molecular-weight polyethylene or a wax having a compatibility with the ultra-high-molecular-weight polyethylene is used as the diluent.

A solvent having a boiling point higher, especially by at least 20° C., than the melting point of the polyethylene is preferred. For example, aliphatic hydrocarbon solvents, aromatic hydrocarbon solvents, hydrogenated derivatives thereof and halogenated hydrocarbon solvents can be mentioned.

An aliphatic hydrocarbon compound or a derivative thereof is used as the wax. The aliphatic hydrocarbon compound is composed mainly of a saturated aliphatic hydrocarbon compound and has a molecular weight lower than 2000, preferably lower than 1000, especially preferably lower than 800, and this wax is generally called "paraffin wax". As the aliphatic hydrocarbon derivative, there can be mentioned aliphatic alcohols, aliphatic amides, aliphatic acid esters, aliphatic mercaptans and aliphatic ketones, which have at least one, preferably one or two, especially one, of a functional group such as a carboxyl group, a hydroxyl group, a carbamoyl group, an ester group, a mercapto group or a carbonyl group, at the end or in the interior of an aliphatic hydrocarbon group (an alkyl group or alkenyl group) and have a carbon number of at least 8, preferably 12 to 50 or a molecular weight of 130 to 2000, preferably 200 to 800.

In the present invention, it is preferred that a wax as mentioned above be used as the diluent. The reason is that if the wax is used, a composition for extrusion is easily obtained by conducting kneading for a relatively short time and degradation of the polyethylene, which results in formation of pittings, is controlled.

It is preferred that the silane compound be incorporated in an amount of 0.1 to 10 parts by weight, especially 0.2 to 5 parts by weight, the radical initiator be used in a catalytic amount, generally 0.01 to 3.0 parts by weight, especially 0.05 to 0.5 parts by weight, and the diluent be used in an amount of 9900 to 33 parts by weight, especially 1900 to 100 parts by weight, per 100 parts by weight of the ultra-high-molecular-weight polyethylene.

If the amount of the silane compound is too small and below the above-mentioned range, the crosslinking degree of the final drawn crosslinked shaped body is too low and the intended improvement of the crystal melting temperature can hardly be obtained. If the amount of silane compound is too large and exceeds the above-mentioned range, the crystallinity of the final drawn crosslinked shaped body is reduced, and the mechanical properties, such as modulus and strength, are degraded. Moreover, since the silane compound is expensive, use of too large an amount of the silane compound is disadvantageous from the economical viewpoint. If the amount of the diluent is too small and below the above-mentioned range, the melt viscosity is too high and melt kneading or melt molding becomes difficult, and surface roughening is extreme and breaking is often caused at the drawing step. If the amount of the diluent is too large exceeds the above-mentioned range, melt kneading is difficult and the drawability of the formed body is poor.

Incorporation of the above-mentioned ingredients to the ultra-high-molecular-weight polyethylene can be performed by optional means. For example, there can be adopted a method in which the silane compound, the radical initiator and the diluent are simultaneously incorporated in the ultra-high-molecular-weight polyethylene and melt kneading is conducted, a method in which the silane compound and the radical initiator are first incorporated in the ultra-high-molecular-weight polyethylene and the diluent is then incorporated, and a method in which the diluent is first incorporated in the ultra-high-molecular-weight polyethylene and the silane compound and the radical initiator are then incorporated.

It is preferred that melt kneading be carried out at a temperature of 150° to 300° C., especially 170° to 270° C. If the melt kneading temperature is too low, the melt viscosity is too high and melt molding becomes difficult. If the melt kneading temperature too high, the molecular weight of the ultra-high-molecular-weight polyethylene is reduced by thermal degradation and it is difficult to obtain a molded body having high modulus and high strength.

Mixing can be accomplished by a dry blending method using a Henschel mixer or a V-type blender or a melt-mixing method using a monoaxial or multi-axial extruder.

The molten mixture is extruded through a spinneret and molded in the form of a filament. In this case, the melt extruded from the spinneret can be subjected to drafting, that is, pulling elongation in the molten state. The draft ratio can be defined by the following formula:

$$\text{Draft ratio} = V/V_o \quad (2)$$

wherein $V_o$ stands for the extrusion speed of the molten polymer in a die orifice and V stands for the speed of winding the cooled and solidified, undrawn extrudate.

The draft ratio is changed according to the temperature of the mixture and the molecular weight of the ultra-high-molecular-weight polyethylene, but the draft ratio is generally adjusted to at least 3, preferably at least 6.

DRAWING

The so-obtained undrawn fiber is then subjected to the drawing treatment. The degree of drawing is adjusted so that molecular orientation is effectively imparted in are axial direction to the ultra-high-molecular-weight polyethylene constituting the fiber. It is generally preferred that drawing of the silane-grafted polyethylene filament be carried out at 40° to 160° C., especially 80° to 145° C. Air, steam or a liquid medium can be used as the heat medium for heating and maintaining the undrawn filament at the above-mentioned temperature. However, if the drawing operation is carried out by using, as the heat medium, a solvent capable of dissolving out and removing the above-mentioned diluent, which has a boiling point higher than the melting point of the molded body-forming composition, such as decalin, decane or kerosine, the above-mentioned diluent can be removed, and at the drawing step, uneven drawing can be obviated and high-draw-ratio drawing becomes possible.

The means for removing the excessive diluent from the ultra-high-molecular-weight polyethylene is not limited to the above-mentioned method. For example there may be adopted a method in which the undrawn molded body is treated with a solvent such as hexane, heptane, hot ethanol, chloroform or benzene and is then drawn, and a method in which the drawn molded body is treated with a solvent such as hexane, heptane, hot ethanol, chloroform or benzene. According to these methods, the excessive diluent in the molded body can be effectively removed, and a drawn fiber having high modulus and high strength can be obtained.

The drawing operation can be carried out in one stage or in two or more stages. The draw ratio depends on the desired molecular orientation, but satisfactory results are generally obtained if the drawing operation is carried out at a draw ratio of 5 to 80, especially 10 to 50.

The monoaxial drawing of the fiber can be accomplished by pulling and drawing the fiber between rollers differing in the peripheral speed.

CROSSLINKING TREATMENT

During or after the above-mentioned drawing operation, the molded body is impregnated with a silanol condensation catalyst, and the drawn molded body is brought into contact with water to effect crosslinking.

Known silanol condensation catalysts, for example, dialkyl tin dicarboxylates such as dibutyl tin dilaurate, dibutyl tin diacetate and dibutyl tin dioctoate, organic titanates such as tetrabutyl titanate, and lead naphthenate can be used as the silanol condensation catalyst. The silanol condensation catalyst in the state dissolved in a liquid medium is brought into contact with the undrawn or drawn fiber, whereby the fiber is effectively impregnated with the silanol condensation catalyst. For example, in the case where the drawing treatment is carried out in a liquid medium, if the silanol condensation catalyst is dissolved in the drawing liquid medium, the impregnation of the fiber with the silanol condensation catalyst can be accomplished simultaneously with the drawing operation.

In the process of the present invention, it is believed that the diluent contained in the formed fiber, such as a wax, promotes uniform permeation of the silanol condensation catalyst in the shaped body..

The shaped fiber may be impregnated with a so-called catalytic amount of the silanol condensation catalyst, and although it is difficult to directly define the amount of the silanol condensation catalyst, if the silanol condensation catalyst is incorporated in an amount of 10 to 100% by weight, especially 25 to 75% by weight, into the liquid medium to be contacted with the undrawn or drawn fiber and the filament is brought into contact with this liquid medium, satisfactory results can be obtained.

The crosslinking treatment of the drawn fiber is accomplished by bringing the silanol condensation catalyst-impregnated silane-grafted ultra-high-molecular-weight polyethylene drawn fiber into contact with water. For the crosslinking treatment, it is preferred that the drawn fiber be contacted with water at a temperature of 50° to 130° C. for 3 to 24 hours. For this purpose, it is preferred that water be applied to the drawn fiber in the form of hot water or hot water vapor. At this crosslinking treatment, moderation of orientation can be prevented by placing the drawn fiber under restraint conditions, or the drawn fiber may be placed under non-restraint conditions so that orientation can be moderated to some extent.

If the drawn fiber is crosslinked and is then subjected to a drawing treatment (the draw ratio is ordinarily lower than 3), the mechanical strength such as tensile strength can be further improved.

SURFACE TREATMENT

According to the present invention, the so-obtained silane-crosslinked drawn fiber is subjected to a plasma treatment or a corona discharge treatment.

Any of apparatuses capable of causing plasma discharge such as high-frequency discharge, microwave discharge or glow discharge can be optionally used for the plasma treatment. Air, nitrogen, oxygen, argon and helium can be used singly or in combination as the treatment atmosphere. Air or oxygen is preferred as the treatment atmosphere. It is preferred that the pressure of the treatment atmosphere be $10^{-4}$ to 10 Torr, especially $10^{-2}$ to 5 Torr. It also is preferred that the treatment energy be 20 to 300 W, especially 50 to 200 W, and the treatment time be 1 to 600 seconds, especially 5 to 300 seconds.

An ordinary corona discharge apparatus, for example, an apparatus supplied by Tomoe Kogyo, can be used for the corona discharge treatment, though the apparatus that can be used is not limited to this type. A bar electrode, a face electrode, a split electrode or the like can be used as the electrode, and a bar electrode is especially preferred. The electrode spacing is 0.4 to 2.0 mm, preferably 0.7 to 1.5 mm. The treatment energy is 0.4 to 500 $W/m^2/min$, preferably 10 to 500 $W/m^2/min$, especially preferably 25 to 200 $W/m^2/min$. If the treatment energy is smaller than 0.4 $W/m^2/min$, no substantial effect of improving the adhesiveness can be attained. If the treatment energy exceeds 500 $W/m^2/min$, convexities and concavities are formed on the surface and the mechanical strength is often reduced.

REINFORCING FIBER

The reinforcing fiber used in the present invention has the above-mentioned crystal melting characteristics and surface chemical characteristics.

In the present invention, the melting point and the quantity of heat of fusion of the crystal are determined according to the following methods.

For the measurement of the melting point, a differential scanning calorimeter (Model DSCII supplied by Perkin-Elmer) is used. The sample (about 3 mg) is wound on an aluminum sheet having a size of 4 mm×4 mm and a thickness of 100μ to restrain the sample in the orientation direction. Then, the sample wound on the aluminum sheet is sealed in an aluminum pan to form a sample for the measurement. An aluminum sheet similar to that used for the sample is sealed in a normally empty aluminum pan to be charged in a reference holder to maintain a heat balance. The sample is held at 30° C. for 1 minute and the temperature is elevated to 250° C. at a rate of 10° C./min, and the measurement of the melting point at the first temperature elevation is completed. The sample is subsequently maintained at 250° C. for 10 minutes, and the temperature is lowered at rate of 20° C./min and the sample is maintained at 30° C. for 10 minutes. Then, the temperature is elevated to 250° C. at a rate of 10° C./min, and the measurement of the melting point at the second temperature elevation (second run) is completed. The melting peak having a maximum value is designated as the melting point. It this peak appears as a shoulder, tangential lines are drawn on the bending points just below and above the shoulder and the intersecting point between the two tangential lines is designated as the melting point.

A base line connecting the points of 60° C. and 240° C. of the endothermic curve is drawn and a perpendicular is drawn on the point higher by 10° C. than the inherent crystal melting temperature (Tm) of ultra-high-molecular-weight polyethylene determined as the main melting peak at the second temperature elevation. Supposing that a low temperature side portion and a high temperature side portion, surrounded by these lines, are based on the inherent crystal fusion (Tm) of ultra-high-molecular-weight polyethylene and the crystal fusion (Tp) manifested by the shaped fiber of the present invention, respectively, the quantities of heat of fusion of the crystal are calculated from the areas of these portions. Similarly, quantities of heat of fusion based on Tp2 and Tp1 are similarly calculated from the areas of the portion surrounded by perpendiculars from (Tm+10) °C. and (Tm+35) °C. and the high temperature side portion, respectively, according to the above-mentioned method.

The degree of the molecular orientation in the shaped fiber can be determined according to the X-ray diffractometry, the birefringence method, the fluorescence polarization method or the like. In view of the heat resistance and mechanical properties, it is preferred that the drawn silane-crosslinked filament used in the present invention be molecularly oriented to such an extent that the orientation degree by the half-value width, described in detail in Yukichi Go and Kiichiro Kubo, Kogyo Kagaku Zasshi, 39 page 992 (1939), that is, the orientation degree (F) defined by the following formula:

$$\text{Orientation degree F.} = \frac{90^\circ - H^\circ/2}{90^\circ}$$

wherein H° stands for the half-value width (°) of the intensity distribution curve along the Debye ring of the intensest paratrope plane on the equator line, is at least 0.90, especially at least 0.95.

The amount of the grafted silane can be determined by subjecting the drawn crosslinked fiber to an extraction treatment in p-xylene at a temperature of 135° C. for 4 hours to remove the unreacted silane or the contained diluent and measuring the amount of Si by the weight method or the atomic-absorption spectroscopy. In view of the heat resistance, it is preferred that the amount of the grafted silane in the fiber used in the present invention be 0.01 to 5% by weight, especially 0.035 to 3.5% by weight, as Si. If the amount of the grafted silane is below the above-mentioned range, the crosslinking density is lower than that specified in the present invention and if the amount of the grafted silane exceeds the above-mentioned range, the crystallinity is reduced, and in each case, the heat resistance becomes insufficient.

The reinforcing fiber of the present invention, in the form of a drawn filament has a modulus of at least 20 GPa, preferable 50 GPa and a tensile strength of at least 1.2 GPa, preferably at least 1.5 GPa.

The single filament denier of the molecularly oriented and silane-crosslinked fiber used in the present invention is not particularly critical, but in view of the strength, it is generally preferred that the fineness of the single filament be 0.5 to 20 denier, especially 1 to 12 denier.

The reinforcing fiber of the present invention is generally used in the form of a multi-filament yarn, and it can also be used in the form of a fibrilated tape.

The reinforcing fiber of the present invention in the filamentary form is processed into a rope, a net, a cloth sheet, a knitted or woven fabric, a nonwoven fabric or a paper and is impregnated or laminated with a matrix material as described below. The reinforcing fiber of the present invention in the form of a tape is processed into a cloth sheet, a rope or the like and is impregnated and laminated with a matrix material as described below. Furthermore, there can be adopted a method in which the filament or tape is appropriately cut and the reinforcer in the staple form is impregnated with a matrix material as described above.

COMPOSITE MATERIAL

As the matrix of the composite material, there can be mentioned inorganic matrix materials, for example, cements such as Portland cement and alumina cement and ceramics such as $Al_2O_3$, $SiO_2$, $B_4C$, $TiB_2$, and $ZrB_2$, and organic matrix materials, for example, thermosetting resins such as a phenolic resin, an epoxy resin, an unsaturated polyester resin, a diallyl phthalate resin, a urethane resin, a melamine resin and a urea resin and thermoplastic resins such as a nylon resin, a polyester resin, a polycarbonate resin, a polyacetal resin, a polyvinyl chloride resin, a cellulose resin, a polystyrene resin and an acrylonitrile/styrene copolymer. Matrix materials having a curing temperature or molding temperature lower than Tp1 of the fiber of the present invention can be bonded by heating. In case of a polar material having a curing temperature or molding temperature higher than Tp1 of the fiber of the present invention, there may be adopted a method in which the fiber of the present invention is impregnated with a solution of this matrix material in an organic solvent or the like, the organic solvent is removed and the impregnated fiber is dried.

The composite material can be formed into a UD (uni-directional) laminated board, a sheet molding compound (SMC), a bulk molding compound (BMC) or the like, as in case of a composite material comprising a glass fiber.

The amount incorporated of the reinforcing fiber in the composite material is adjusted to 10 to 90% by weight, especially 50 to 85% by weight.

According to the present invention, there is provided a reinforcing fibrous material having a good adhesion to a matrix in a composite material while substantially retaining excellent heat resisting and mechanical properties possessed by the molecularly oriented and silane-crosslinked ultra-high-molecular-weight polyethylene fiber.

More specifically, this reinforcing fiber is highly improved in the adhesiveness and heat resisting over conventional shaped products subjected to a corona discharge treatment, and the retention ratio of the mechanical strength such as modulus or strength in the shaped body is at least 85%, preferably at least 90% and there is no substantial reduction of the mechanical strength. By utilizing these characteristics, the reinforcing fibrous material can be combined with various polar materials and used for the production of sporting goods such as rackets, skis, fishing rods, golf clubs and bamboo swords, leasure goods such as yachts, boats and surfing boards, protectors such as helmets and medical supplies such as artificial joints and dental plates In these articles, the mechanic properties such as flexural strength and flexural elastic modulus are highly improved.

The present invention will now be described in detail with reference to the following examples that by no means limit the scope of the invention.

EXAMPLE 1

Grafting and Spinning 100 parts by weight of powdery ultra-high-molecular-weight polyethylene (intrinsic viscosity ($\eta$)=8.20 dl/g) was homogeneously mixed with 10 parts by weight of vinyltrimethoxysilane (supplied by Shinetsu Kagaku) and 0.1 part by weight of 2,5-dimethl-2,5-di(-tert-butylperoxy)hexane (Perhexa 25B supplied by Nippon Yushi), and powdery paraffin wax (Luvax 1266 supplied by Nippon Seiro, melting point=69° C.) was further added in an amount of 370 parts by weight per 100 parts by weight of the ultra-high-molecular-weight polyethylene. Then, the mixture was melt-kneaded at set temperature of 200° C. by using a screw type extruder (screw diameter=20 mm, L/D=25), and the melt was spun from a die having an orifice diameter of 2 mm to complete silane grafting. The spun fiber was cooled and solidified by air maintained at room temperature at an air gap of 180 cm to obtain an undrawn silane-grafted ultra-high-molecular-weight polyethylene fiber. The draft ratio at the spinning step was 36.4. The winding speed was 90 m/min.

Determination of Amount of Grafted Silane

In 200 cc of p-xylene heated and maintained at 135° C. was dissolved about 8 g of the undrawn grafted fiber prepared according to the above-mentioned method, and then, the ultra-high-molecular-weight polyethylene was precipitated in an excessive amount of hexane at normal temperature to remove the paraffin wax and unreacted silane compound. Then, the grafted amount as the amount (% by weight) of Si was determined by the weight method. It was found that the grafted amount was 0.58% by weight.

Drawing

The grafted undrawn fiber spun from the ultra-high-molecular-weight polyethylene composition according to the above-mentioned method was drawn under conditions described below to obtain an oriented drawn fiber. Namely, two-staged drawing was carried out in drawing tanks containing n-decane as the heating medium by using three godot rolls. The temperature in the fiber drawing tank was 110° C. and the temperature in the second drawing tank was 120° C., and the effective length of each tank was 50 cm. A desired draw ratio was obtained by changing the rotation number of the third godet roll while maintaining the rotation speed of the first godet roll at 0.5 m/min. The rotation speed of the second godet roll was appropriately selected within a range where stable drawing was possible. The draw ratio was calculated from the rotation ratio between the first and third godet rolls.

The obtained fiber was dried at room temperature under reduced pressure to obtain a silane-grafted ultra-high-molecular-weight polyethylene fiber.

Impregnation with Crosslinking Catalyst

In the case where the silane compound-grafted oriented ultra-high-molecular-weight polyethylene fiber was further crosslinked, a mixture of n-decane and dibutyl tin dilaurate in the same amount as that of n-decane was used as the heating medium in the second drawing tank at the drawing step, and simultaneously with extraction of the paraffin wax, the fiber was impregnated with dibutyl tin dilaurate. The obtained fiber was dried at room temperature under reduced pressure until the decane smell was not felt.

Crosslinking

Then, the fiber was allowed to stand in boiling water for 12 hours to complete crosslinking.

Measurement of Gel Content

About 0.4 g of the silane-crosslinked drawn ultra-high-molecular-weight polyethylene fiber obtained according to the above-mentioned method was charged in an Erlenmeyer flask equipped with a condenser, in which 200 ml of p-xylene was charged, and the fiber was stirred in the boiled state for 4 hours. The insoluble substance was recovered by filtration using a 300-mesh stainless steel net, dried at 80° C. under reduced pressure and weighed to determine the proportion of the insoluble substance. The gel content was calculated according to the following formula:

$$\text{Gel content (\%)} = \frac{\text{weight of insoluble substance}}{\text{weight of sample}} \times 100$$

The gel content in the above-mentioned sample was 51.4%.

The tensile modulus, tensile strength and elongation at the breaking point were measured at room temperature (23° C.) by using an Instron universal tester (Model 1123 supplied by Instron Co.). The sample length between clamps was 100 mm and the pulling speed was 100 m/min. Incidentally, the tensile modulus is the initial modulus. The sectional area of the fiber necessary for the calculation was determined from the measured values of the weight and length of the fiber based on the assumption that the density of the polyethylene was 0.96 g/cm$^3$.

The physical properties of the so-obtained silane-crosslinked drawn ultra-high-molecular-weight polyethylene fiber are shown in Table 1.

TABLE 1

| Sample | Sample 1 |
|---|---|
| Fineness | 9.9 denier |
| Draw Ratio | 19.0 |
| Strength | 1.40 GPa |
| Modulus | 55 GPa |
| Elongation | 6.9% |

The inherent crystal melting temperature (Tm) of the ultra-high-molecular-weight polyethylene obtained as the main melting peak at the time of the second temperature elevation was 132.4° C. The ratio of the heat of fusion based on Tp to the total crystal heat of fusion and the ratio of the heat of fusion based on Tp1 to the total crystal heat of fusion were 72% and 23%, respectively. The main peak of Tp2 resided at 151.1° C. and the main peak of Tp1 resided at 226.6° C.

Evaluation of Creep Characteristics

Figure 5:
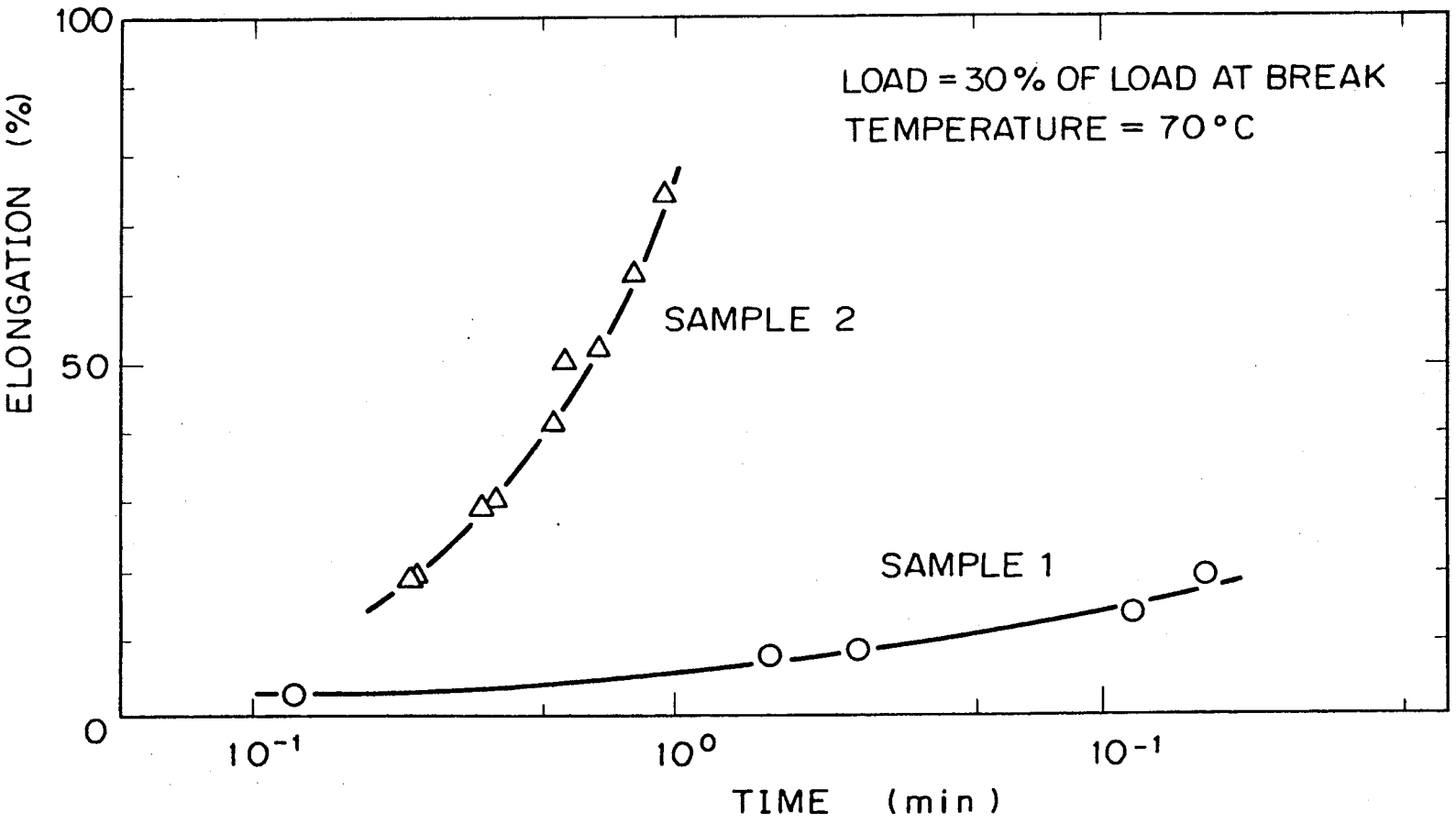
FIG. 5 is a graph illustrating creep characteristics of the molecularly oriented, silane-crosslinked ultra-high-molecular-weight polyethylene fiber obtained in Example 1.

The creep test was carried out at an atmosphere temperature of 70° C. and a sample length of 1 cm by using a thermal stress strain measurement apparatus (Model TMA/SS10 supplied by Seiko Denshi Kogyo). The results obtained when the measurement was conducted under a load corresponding to 30% of the breaking load are shown in FIG. 5. It is seen that the silane-crosslinked drawn ultra-high-molecular-weight polyethylene fiber obtained in the present example (sample 1) was highly improved in the creep characteristics over a drawn ultra-high-molecular-weight polyethylene fiber obtained in Comparative Example 1 given hereinafter (sample 2).

Furthermore, the creep test was carried out at an atmosphere temperature of 70° C. under a load corresponding to 50% of the breaking load at room temperature. The elongations observed after the lapse of 1 minute, 2 minutes and 3 minutes from the point of application of the load are shown in Table 2.

TABLE 2

| Sample | Time(minutes) | Elongation (%) |
|---|---|---|
| Sample 1 | 1 | 7.4 |
| Sample 1 | 2 | 8.2 |
| Sample 1 | 3 | 8.6 |

Strength Retention Ratio after Heat History

The heat history test was conducted by allowing the sample to stand still in a gear oven (Perfect Oven supplied by Tabai Seisakusho). The sample had a length of about 3 m and was folded on a stainless steel frame having a plurality of pulleys arranged on both the ends thereof. Both the ends of the sample were fixed to such an extent that the sample did not slacken, but any tension was not positively applied to the sample. The obtained results are shown in Table 3.

TABLE 3

| Sample | sample 1 | sample 1 |
|---|---|---|
| Oven Temperature | 180° C. | 200° C. |
| Standing Time | 10 minutes | 5 minutes |
| Strength | 1.53 GPa | 1.40 GPa |
| Strength Retention Ratio | 99% | 90% |
| Modulus | 32.5 GPa | 26.5 GPa |
| Modulus Retention Ratio | 81% | 66% |
| Elongation | 9.5% | 10.7% |
| Elongation Retention Ratio | 126% | 143% |

Plasma Treatment

The obtained molecularly oriented and silane-crosslinked ultra-high-molecular-weight polyethylene fiber (1000 denier/100 filaments) was treated for 10 seconds by a high-frequency plasma treatment apparatus (supplied by Samco International Research Institute) at an output 100 W under a pressure of 1 Torr by using oxygen as the treating gas. An electron microscope photograph of the surface of the fiber before the plasma treatment is shown in FIG. 4, and an electron microscope photograph of the fiber after the plasma treatment is shown in FIG. 3.

The treated fiber had a strength of 1.70 GPa (retention ratio=100%) and an elastic modulus of 52.1 GPa (retention ratio=94.7%).

By the ESCA analysis of the surface of the fiber, it was confirmed that the number of oxygen atoms per 100 carbon atoms was smaller than 6 in the fiber before the plasma treatment but the number of oxygen atoms per 100 carbon atoms was increased to 22 by the plasma treatment.

Preparation of Composite Material

The plasma-treated fiber was impregnated with a resin composition comprising two epoxy resins (Epomik® R-301M80 and R-140 supplied by Mitsui Petrochemical Industries, Ltd.), dicyandiamide, 3-(p-chlorophenyl-1,1-dimethylurea and dimethylformamide at a weight ratio of 87.5/30/5/5/25, and the impregnated resin was dried at 100° C. for 10 minutes to prepare a prepreg. The so-prepared prepregs were laminated and press-molded at 100° C. for 1 hour to obtain a unidirectional laminated board. The flexural strength and flexural elastic modulus of the laminated board were measured according to the method of JIS K-6911. The obtained results are shown in Table 4.

The amount of the fiber was 79% by weight based on the entire composite material.

EXAMPLE 2

The molecularly oriented and silane-crosslinked ultra-high-molecular-weight polyethylene fiber used in Example 1 was treated in the same apparatus as used in Example 1 by using nitrogen as the treatment gas. By using the so-treated fiber, a laminated board was prepared under the same conditions as described in Example 1. The obtained results are shown in Table 4.

The results of the electron microscope observation of the surface of the fiber were the same as shown in FIG. 3. The strength of the treated fiber was 1.69 GPa (retention ratio=99.4%) and the elastic modulus was 54.0 GPa (retention ratio=98.2%) By the ESCA analysis, it was confirmed that the number of oxygen atoms per 100 carbon atoms was 10.

EXAMPLE 3

The molecularly oriented and silane-crosslinked ultra-high-molecular-weight polyethylene fiber used in Example 1 was treated by a corona discharge treatment apparatus supplied by Tomoe Kogyo. Bar electrodes were used and the spacing between the electrodes was 1.0 mm, and the irradiation dose was 75 $W/m^2/min$. The results of the electron microscope of the surface of the fiber were the same as shown in FIG. 3.

The strength of the treated fiber was 1.69 GPa (retention ratio=99.4%) and the elastic modulus was 53.0 GPa (retention ratio=96.4%). By the ESCA analysis, it was confirmed that the number of added oxygen atoms per 100 carbon atoms was 17. By using this fiber, a laminated board was prepared under the same conditions as described in Example 1. The obtained results are shown in Table 4.

COMPARATIVE EXAMPLE 1

The same silane-crosslinked high-tenacity and high-elastic-modulus fiber as used in Example 1 was used without any treatment and a laminated board was prepared under the same conditions as described in Example 1.

TABLE 4

| | Flexural Strength ($kg/mm^2$) | Flexural Elastic Modulus ($kg/mm^2$) | O/C* |
|---|---|---|---|
| Example 1 | 22.5 | 2520 | 22 |
| Example 2 | 21.8 | 2530 | 10 |
| Example 3 | 20.9 | 2490 | 17 |

TABLE 4-continued

| | Flexural Strength ($kg/mm^2$) | Flexural Elastic Modulus ($kg/mm^2$) | O/C* |
|---|---|---|---|
| Comparative Example 1 | 15.0 | 2300 | 6 |

Note
*number of oxygen atoms per 100 carbon atoms

We claim:

1. A reinforcing fibrous material having an improved adhesion, which consists essentially of a surface-treated molecularly oriented, silane-crosslinked ultra-high-molecular-weight polyethylene fiber, wherein, when the measurement is conducted under restraint conditions by using a differential scanning calorimeter, the crosslinked polyethylene fiber has at least two crystal melting peaks (Tp) at temperatures higher by at least 10° C. than the inherent crystal melting temperature (Tm) of the ultra-high-molecular-weight polyethylene determined as the main peak at the time of the second temperature elevation, the heat of fusion based on these crystal melting peaks (Tp) is at least 50% of the whole heat of fusion, and the sum of heat of fusion of high-temperature side peaks (Tp1) at temperatures in the range of from Tm+35)°C. to (Tm+120° C. is at least 5% of the whole heat of fusion, and wherein the surface-treated crosslinked polyethylene fiber has a smooth surface containing at least 8 oxygen atoms per 100 carbon atoms, as determined by the electron spectroscopy for chemical analysis (ESCA), with the width of surface cracks in the orientation direction controlled below 0.1 μm.

2. The reinforcing fibrous material as set forth in claim 1, wherein the surface-treated fiber is a fiber obtained by grafting a silane compound to polyethylene having an intrinsic viscosity ($\eta$) of at least 5 dl/g as measured at 135° C. in decalin as the solvent, shaping the grafted polyethylene into a fiber, drawing the fiber, crosslinking the drawn silane-grafted fiber and subjecting the silane-crosslinked fiber to a plasma treatment or a corona discharge treatment.

3. The reinforcing fibrous material as set forth in claim 1, wherein the surface-treated fiber has an orientation degree (F) of at least 0.90.

4. The reinforcing fibrous material as set forth in claim 1, wherein the surface-treated fiber has an elastic modulus of at least 20 GPa and a tensile strength of at least 1.2 GPa.

5. The reinforcing fibrous material as set forth in claim 1, wherein the surface contains at least 10 oxygen atoms per 100 carbon atoms as determined by ESCA.

6. The reinforcing fibrous material as set forth in claim 2, wherein said plasma treatment is effected in an atmosphere selected from the group consisting of air, nitrogen, oxygen, argon, helium and mixtures thereof; at a pressure of $10^{-4}$ to 10 Torr; at a treatment energy of 20 to 300 W; for a treatment duration of 1 to 600 seconds.

7. The reinforcing fibrous material as set forth in claim 6, wherein said plasma treatment is effected in an atmosphere of air or oxygen.

8. The reinforcing fibrous material as set forth in claim 6, wherein said pressure is $10^{-2}$ to 5 Torr.

9. The reinforcing fibrous material as set forth in claim 6, wherein said treatment energy is 50 to 200 W.

10. The reinforcing fibrous material as set forth in claim 6, wherein said treatment duration is 5 to 300 seconds.

11. The reinforcing fibrous material as set forth in claim 2, wherein said corona discharge treatment is effected utilizing an electrode spacing of 0.4 to 2.0 mm; and a treatment energy of 0.4 to 500 $W/m^2/min$.

12. The reinforcing fibrous material as set forth in claim 11, wherein said electrode spacing is 0.7 to 1.5 mm.

13. The reinforcing fibrous material as set forth in claim 11, wherein said treatment energy is 10 to 500 $W/m^2/min$.

14. The reinforcing fibrous material as set forth in claim 11, wherein said treatment energy is 25 to 200 $W/m^2/min$.

15. The reinforcing fibrous material as set forth in claim 1, wherein in the surface-treated fiber, the width of surface cracks in the orientation direction is below 0.08 μm.

* * * * *